US008307605B2

(12) United States Patent
McCarty

(10) Patent No.: US 8,307,605 B2
(45) Date of Patent: Nov. 13, 2012

(54) DOME KIT, STRUCTURE AND METHOD

(76) Inventor: Gerald Joseph McCarty, Tucson, AZ (US)

( * ) Notice: Subject to any disclaimer, the term of this patent is extended or adjusted under 35 U.S.C. 154(b) by 814 days.

(21) Appl. No.: 12/054,148

(22) Filed: Mar. 24, 2008

(65) Prior Publication Data

US 2008/0236057 A1 Oct. 2, 2008

Related U.S. Application Data

(60) Provisional application No. 60/920,029, filed on Mar. 26, 2007.

(51) Int. Cl.
*E04B 1/32* (2006.01)

(52) U.S. Cl. ..... 52/745.07; 52/80.1; 52/81.3; 52/86

(58) Field of Classification Search ..... 52/745.07, 52/80.1, 80.2, 81.3, 82, 86, 655.1, 653.1, 52/81.1–81.4, 87–89
See application file for complete search history.

(56) References Cited

U.S. PATENT DOCUMENTS

| | | | | |
|---|---|---|---|---|
| 2,582,723 | A | | 1/1952 | Stemmons et al. |
| 3,270,470 | A | | 9/1966 | Wilkie et al. |
| 3,462,893 | A | * | 8/1969 | Kaiser ..... 52/81.3 |
| 3,633,547 | A | | 1/1972 | Stevens et al. |
| 3,703,307 | A | * | 11/1972 | Curtis ..... 403/173 |
| 3,894,367 | A | | 7/1975 | Yacoboni |
| 3,916,589 | A | | 11/1975 | Richter |
| 3,999,336 | A | | 12/1976 | Bance |
| 3,999,337 | A | | 12/1976 | Tomassetti et al. |
| 4,133,150 | A | * | 1/1979 | Yacoboni ..... 52/81.2 |
| 4,244,152 | A | | 1/1981 | Harper, Jr. |
| 4,245,809 | A | | 1/1981 | Jackson |
| 4,260,276 | A | | 4/1981 | Phillips |
| 4,357,782 | A | | 11/1982 | Peter |
| 4,400,927 | A | | 8/1983 | Wolde-Tinase |
| 4,402,422 | A | | 9/1983 | Honath et al. |
| 4,449,843 | A | * | 5/1984 | Wendel ..... 403/173 |
| 4,488,392 | A | | 12/1984 | Pearcey et al. |
| 4,541,210 | A | | 9/1985 | Cook |
| 4,633,547 | A | | 1/1987 | Caroon |
| 4,663,898 | A | * | 5/1987 | Yacaboni ..... 52/82 |
| 4,671,693 | A | | 6/1987 | Rossman |
| 4,698,941 | A | | 10/1987 | Rieder et al. |
| 4,720,947 | A | * | 1/1988 | Yacaboni ..... 52/81.3 |
| 5,067,288 | A | | 11/1991 | Takahama et al. |
| 5,130,915 | A | | 7/1992 | Lerch |
| 5,146,719 | A | | 9/1992 | Saito et al. |
| 5,170,559 | A | | 12/1992 | Orthey et al. |
| 5,170,599 | A | * | 12/1992 | Knight ..... 52/91.1 |
| 5,313,763 | A | | 5/1994 | Oram |
| 5,371,983 | A | | 12/1994 | Kawaguchi et al. |
| 5,440,840 | A | | 8/1995 | Levy |
| 5,502,928 | A | | 4/1996 | Terry |
| 5,724,775 | A | | 3/1998 | Zobel, Jr. et al. |

(Continued)

*Primary Examiner* — William Gilbert
*Assistant Examiner* — Alp Akbasli

(57) ABSTRACT

A new and useful Dome Kit, dome shaped structural system and method of assembling a dome shaped structural system is provided. The Dome Kit and method are used to form a dome shaped structural system comprising a compression ring, a lower ring that is larger than the compression ring and spaced below the compression ring, and a plurality of ribs connected with the compression ring. The lower ring, the compression ring, lower ring and connected ribs form a dome shaped structural system; i.e. a structural system with a dome shaped appearance. New and useful structure is provided for coupling the ribs to the compression ring and to the lower ring. Such structure is particularly useful when the ribs are formed of metal (e.g. steel).

2 Claims, 11 Drawing Sheets

U.S. PATENT DOCUMENTS

| | | | | |
|---|---|---|---|---|
| 5,857,294 | A | 1/1999 | Castro | |
| 6,202,361 | B1 | 3/2001 | Thorp et al. | |
| 6,282,842 | B1 | 9/2001 | Simens | |
| 6,324,791 | B1 * | 12/2001 | Azpiroz Villar | 52/80.1 |
| 6,324,792 | B1 * | 12/2001 | DeGarie | 52/80.1 |
| 6,748,712 | B2 * | 6/2004 | Likozar et al. | 52/506.07 |
| 6,854,219 | B1 * | 2/2005 | Kelly et al. | 52/86 |
| 7,152,384 | B1 * | 12/2006 | McCarty | 52/639 |
| 7,237,363 | B2 * | 7/2007 | Wilson | 52/80.1 |
| 2003/0101663 | A1 * | 6/2003 | Boots | 52/81.3 |
| 2005/0210767 | A1 * | 9/2005 | DeFever et al. | 52/80.1 |
| 2006/0162263 | A1 * | 7/2006 | Ludwig | 52/80.1 |

* cited by examiner

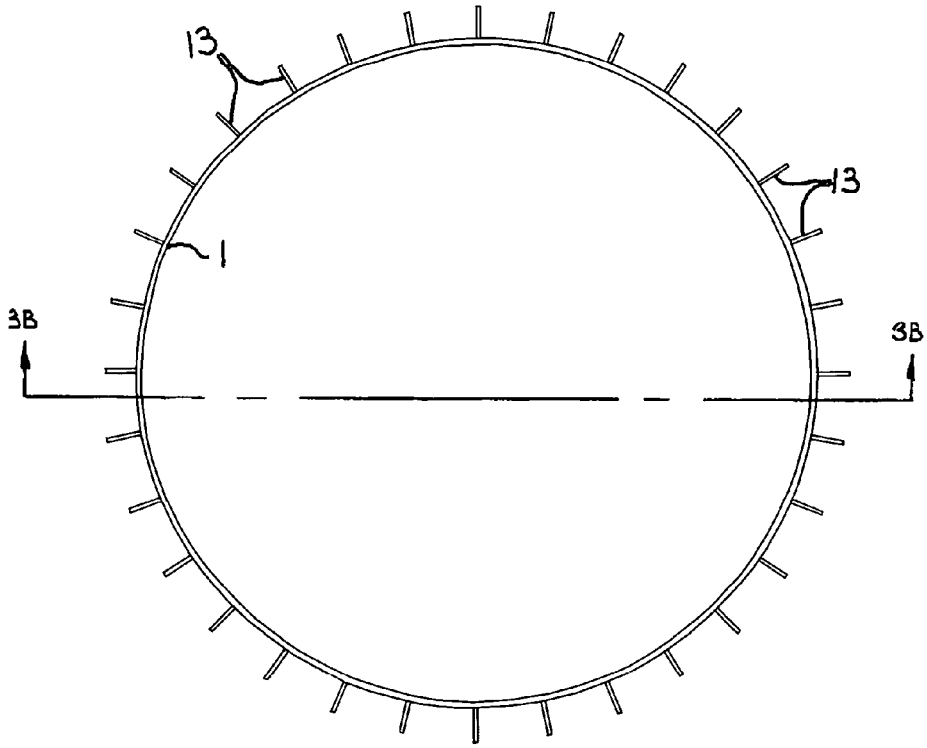
FIG
3A
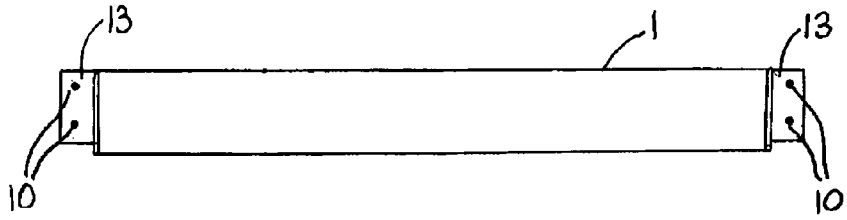
FIG.
3B

DOME KIT, STRUCTURE AND METHOD

RELATED APPLICATION/CLAIM OF PRIORITY

This application is related to and claims priority from provisional application Ser. No. 60/920,029, filed Mar. 26, 2007, which provisional application is incorporated by reference herein.

BACKGROUND AND SUMMARY

Applicant's U.S. Pat. No. 7,152,384 (which is incorporated herein by reference), describes a new and useful dome kit and method, to provide a dome structure that is designed to be efficient to assemble, structurally sound, and produce an aesthetically pleasing appearance when forming a part of a building structure. The present invention utilizes the concepts of U.S. Pat. No. 7,152,384, which is incorporated by reference herein, to provide a dome kit and method, with some additional new and useful features that can be utilized, particularly when the dome structure is formed primarily of metal (preferably steel) components.

For example, the concepts of the present invention enables a dome structure to be formed in the manner provided by U.S. Pat. No. 7,152,384, and also provides a new and useful way of coupling ribs to the compression ring at the top of the dome structure. Moreover, the invention also provides a new and useful way of coupling the ribs to the lower ring. Such coupling structure is particularly useful when the ribs are made of metal (e.g. steel).

These and other features of the present invention will become further apparent from the following detailed description and the accompanying drawings.

BRIEF DESCRIPTION OF THE SEVERAL VIEWS OF THE DRAWINGS

FIG. 3A is a schematic, plan view of a compression ring showing the rib mounting flanges for connecting the ribs;

FIG. 3B is a sectional view of the compression ring of FIG. 3A, taken from the direction 3B-3B;

FIGS. 5B and 5C are side views of the connection between the upper portion of a steel rib with the compression rib (FIG. 5B), and between the lower portion of a steel rib with the lower ring (FIG. 5C): and.

DETAILED DESCRIPTION

As described above, the dome kit and method of the present invention utilizes the concepts of Applicant's U.S. Pat. No. 7,152,384 (which is incorporated herein by reference), to provide a dome structure, and also provides some additional new and useful features that can be utilized in forming the dome structure (especially a dome structure that is formed primarily of metal (preferably steel) components, although aluminum and/or titanium may also be acceptable metals).

A dome structure according to the principles of the present invention can be produced from a kit that includes the parts set forth in the parts list described below. All parts for forming a dome shaped structural system are preferably included in the kit. The kit also preferably includes text and drawings that provide a clear and concise method for assembly of the parts into the dome shaped structural system. The builder who will be moving and placing the dome shaped structural system after it is fully assembled should also be aware of the logistics involved and coordinate his efforts with those of the assemblers. The moving and placing of a fully assembled dome shaped structural system is not considered part of the present invention.

Figure 1:
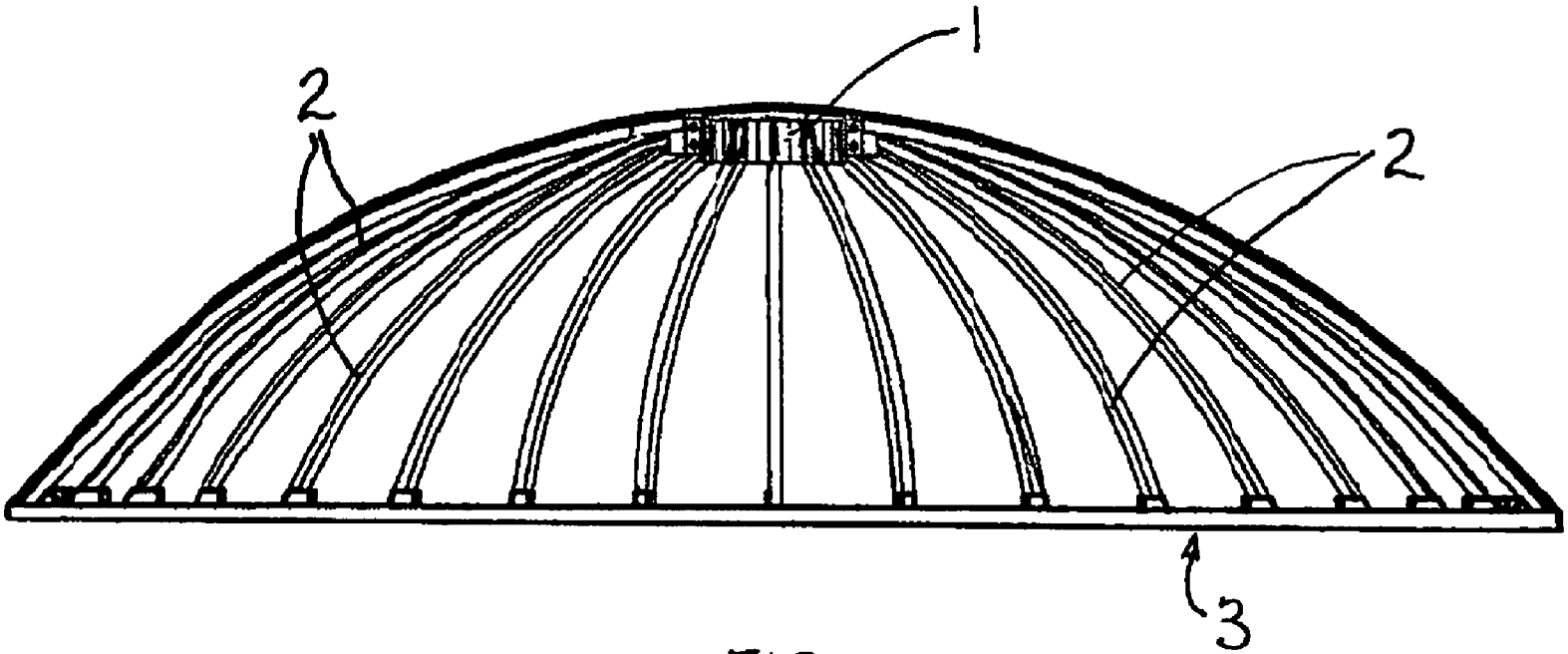
FIG. 1 is a schematic, elevational illustration of an assembled dome shaped structural system, according to the principles of the invention, showing the main elements of the system (i.e. compression ring, ribs and lower ring)

As illustrated in FIG. 1, a dome shaped structure according to the present invention, has three main members; namely a lower steel ring 3 called the tension ring, an upper steel ring 1 called the compression ring, and connecting members 2 that are ribs (e.g. steel ribs extending between and connected with the lower ring 3 and the compression ring). The dome shaped structure is fabricated using these basic elements. The dome shaped structure will have varied dimensions in diameter, height and rib radius. In this elevation one may think of the dome shaped structure as a fully assembled system that is ready for exterior sheathing and finishes and in the assembled state is ready to be lifted as one piece onto a building structure.

Figure 2:
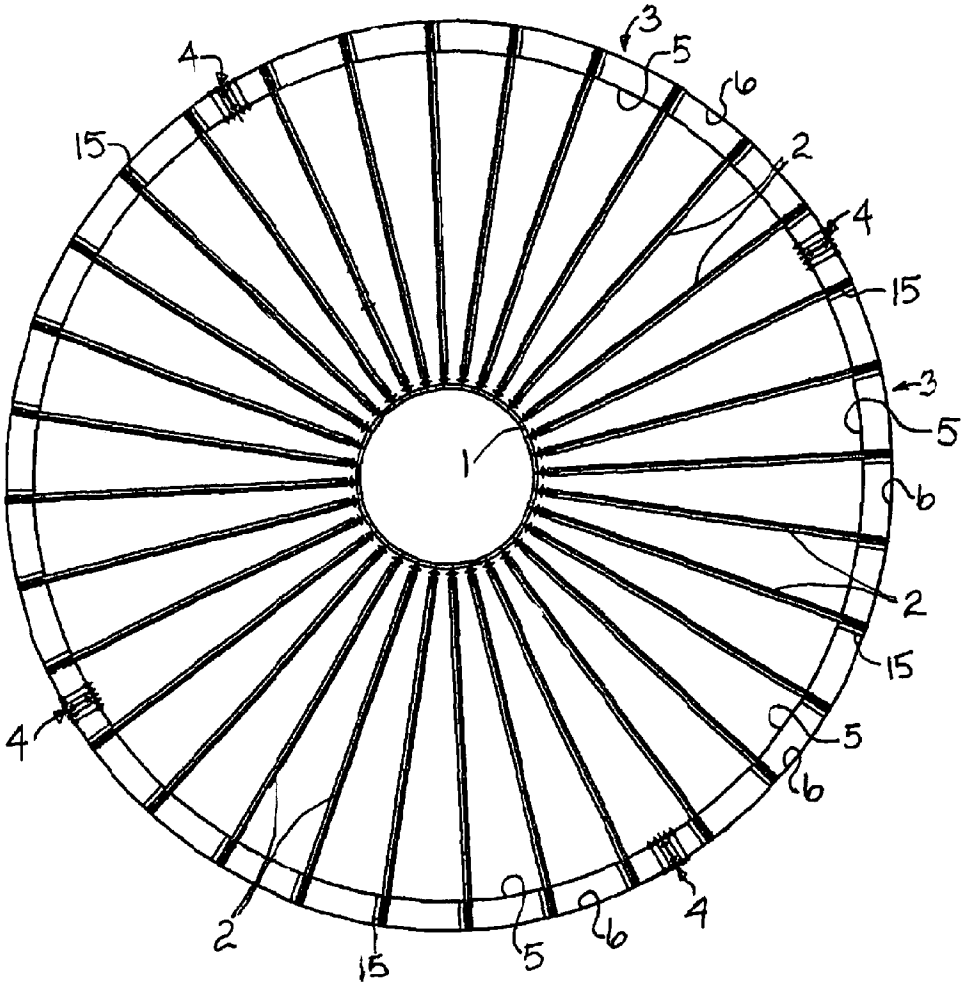
FIG. 2 is a schematic plan view of an assembled dome shaped structural system, according to the present invention, with a layout showing compression ring, steel ribs and lower steel ring formed of sections that are spliced together, in a manner described in U.S. Pat. No. 7,152,384 and also described herein.

As shown in FIG. 2, the dome shaped structure, in plan view has a basic circular geometry, with the compression ring 1 and lower tension ring 3 essentially concentric with each other.

Figure 2A:
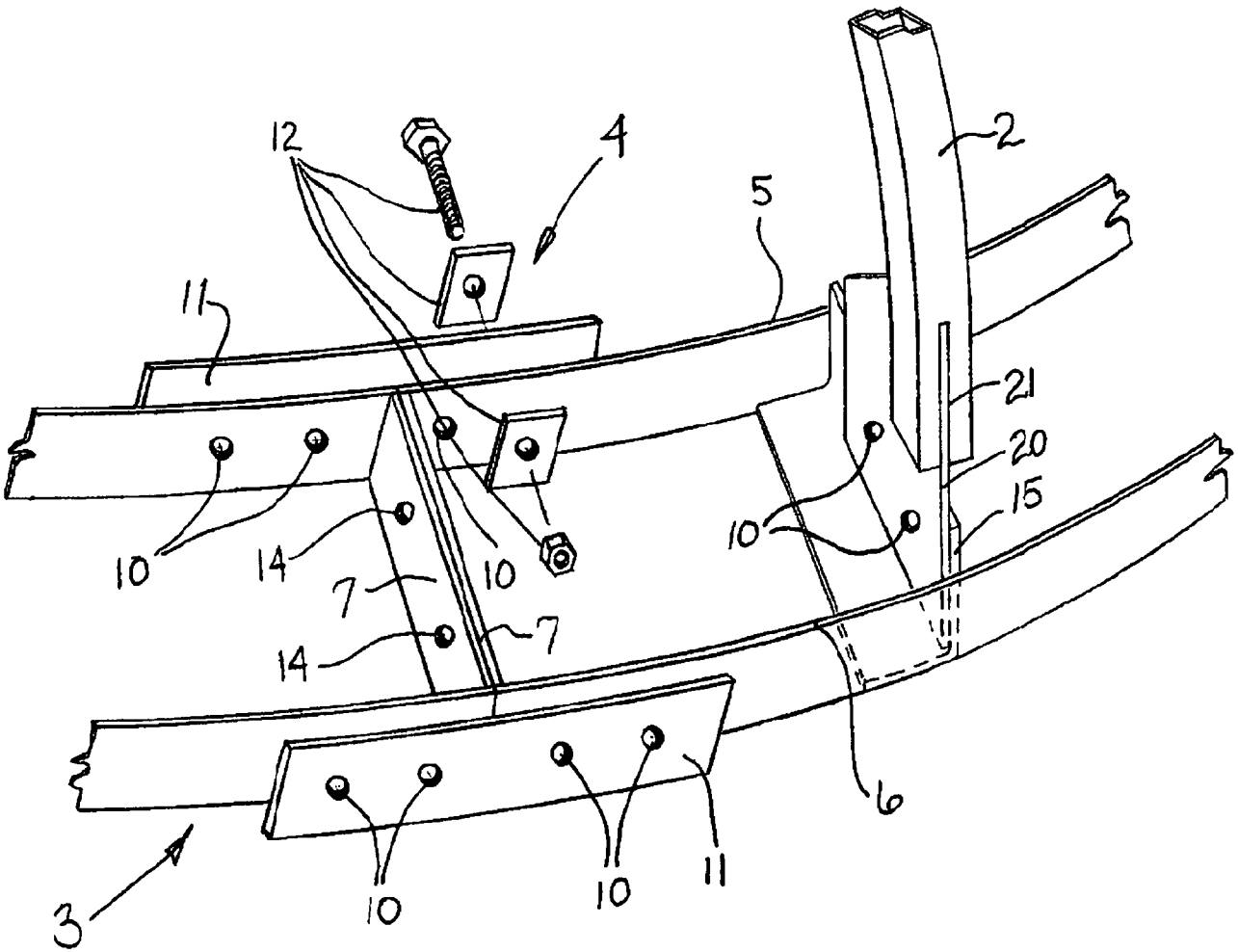
FIG. 2A is a fragmentary, partially exploded view of the components that connect the lower ring sections together, and structure that connects a rib to the lower ring.

FIG. 2 shows the locations of several splice assemblies 4, which are used to connect sections of the lower tension ring to each other, to form a full lower tension ring. FIG. 2A shows the details of a splice detail and splice kit assembly 4 whereby the ends of two sections of the lower steel rings or tension ring are joined to each other in forming the lower steel tension ring 3. The inner and outer concentric rings 5, 6 that are parts of the lower tension ring 3 are shown being joined firstly by steel bars or gussets 7 that are factory welded to the inner and outer rings and have matching bolt holes 14, each of which is dimensioned to receive a ¾ bolt. At the inside and outside of the inner and outer rings 5, 6, a 4 hole splice plate 11 is applied and fastened with ⅝" standard steel bolts, nuts and washers (collectively shown at 12). This detail gives the viewer an understanding as to how the lower ring sections are joined as they lay on a flat surface and before any other members of the dome assembly can begin.

Figure 2B:
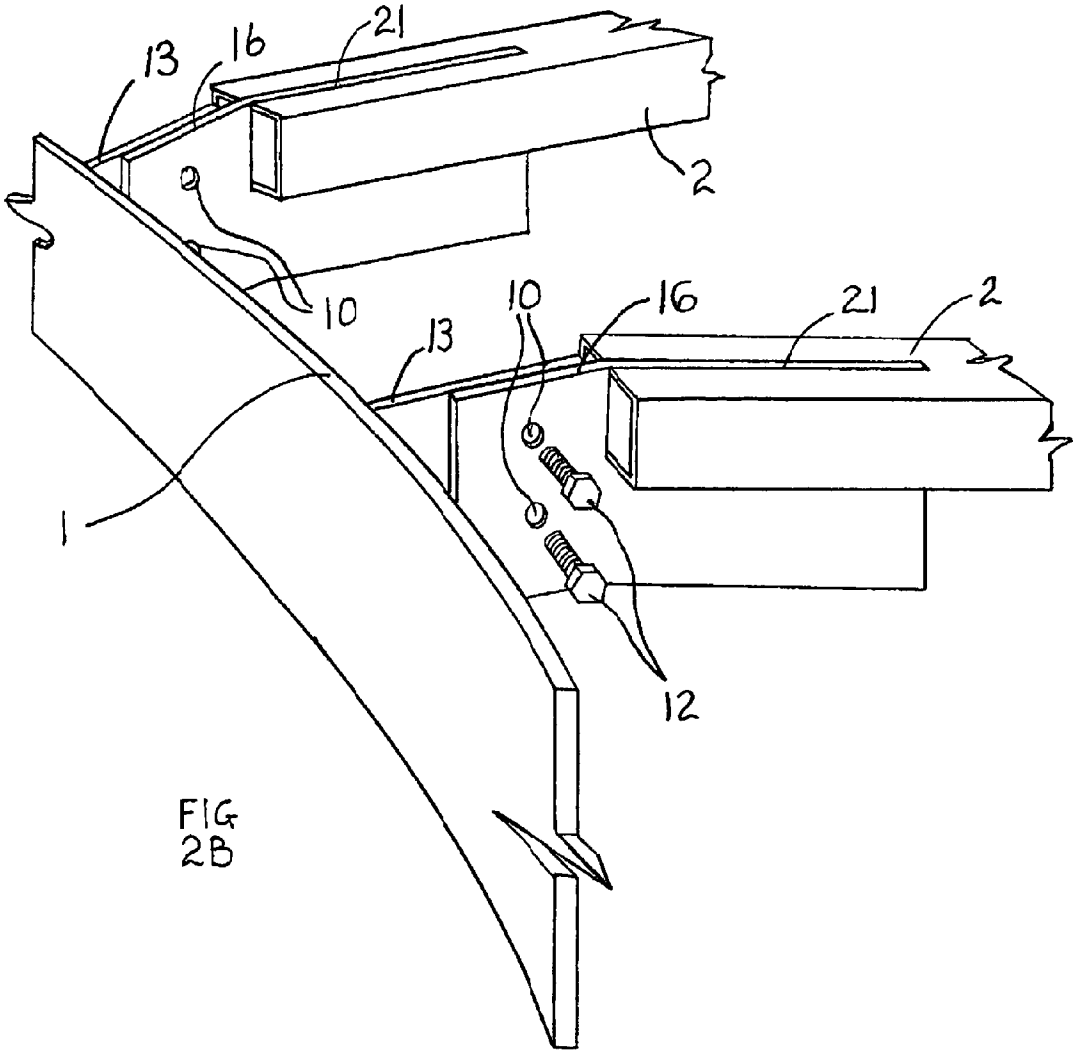
FIG. 2B is a fragmentary view of components that connect the upper portions of the ribs to the compression ring.

FIG. 2B shows connector detail by which the upper end of steel rib 2 (which is a rolled steel tubular member with upper and lower ends, and a predetermined curvature between the upper and lower ends) is connected to the upper steel compression ring 1. The outer vertical face of the compression ring 1 has steel rib mounting flanges 13 that are welded on at the factory. Each steel rib mounting flange 13 has bolt holes 10 that are used in connecting the compression ring with a plate (or tongue) 16 that extends from a steel rib 2. At the upper end of the steel rib a slot 21 in the rib is made at the factory and a flat steel bar (also referred to as a tongue) 16 is placed partially in and welded to the slot 21, to fix the tongue to the upper end of the steel rib. This welded connection at the factory results in the portion of the tongue 16 that extends out of the slot to mate with and be the field connector to a steel rib mounting flange 13 of the compression ring. The connection uses 2 each, ⅝" bolts and nuts 12.

Figure 2C:
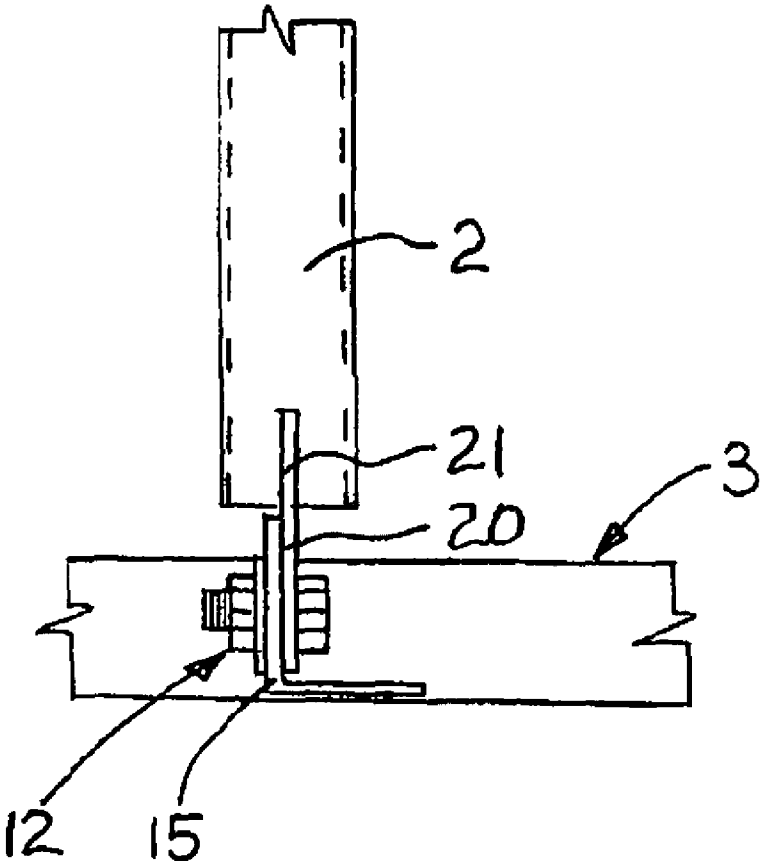
FIG. 2C is a schematic illustration of the connection of the lower portions of the ribs to the lower ring.

FIG. 2C, which is a detail at lower tension ring 3, shows the connection made between the a steel plate (or tongue) 20 on the lower end of the tubular rolled steel rib 2 and the lower concentric inner and outer steel rings 5, 6 that form the lower tension ring 3. (It should be noted that while the tubular rolled steel rib 2 is shown in FIG. 2C as having a substantially square cross section, and the steel rib is shown in FIG. 2A as appearing to have a more rectangular cross section, the square shaped cross section of FIG. 2C is the more likely cross sectional configuration of the tubular rolled steel rib 2). The inner and outer steel rings 5, 6 are joined at the factory using steel angles 15 that are located at the places where the ribs 2 are to connect to the lower tension ring 3. The size of each of these angles is typically 4"×4"×¼" 15 with a length of 11½" but for all cases these angles are not limited to these dimensions. The detail further shows a slot 21 in the rib 2 that is made at the factory and a flat steel bar that forms the lower tongue 20 is placed and welded, to fix the lower tongue 20 to the steel rib. This welded connection at the factory connects one end of the plate or tongue 20 to the rib and enables the portion of the tongue 20 that extends out of the slot to be configured to mate with and be connected (e.g. bolting) to an angle member 15 extending between the lower steel components 5, 6 of the lower tension ring. The connection uses two each, ⅝" bolts and nuts 12 that are similar to the bolts and nuts that connect the splice plates 11 to the lower ring sections 5, 6.

FIG. 3A, which is a Plan View of the compression ring 1 shows the circular geometry of the steel compression ring 1 with the rib mounting flanges 13 at the outer vertical face. The rib mounting flanges 13 are factory welded to the compression ring and are spaced around the outside of the compression ring.

FIG. 3B, which is a cross section of the steel compression ring 1 shows the vertical and horizontal configurations of the compression ring and the factory applied steel rib mounting flanges 13. The steel rib mounting flange placement on the outer face of the compression ring is established so as to allow the correct fit and connection of the steel ribs 2 based on the dome design at that time.

Figure 4A:
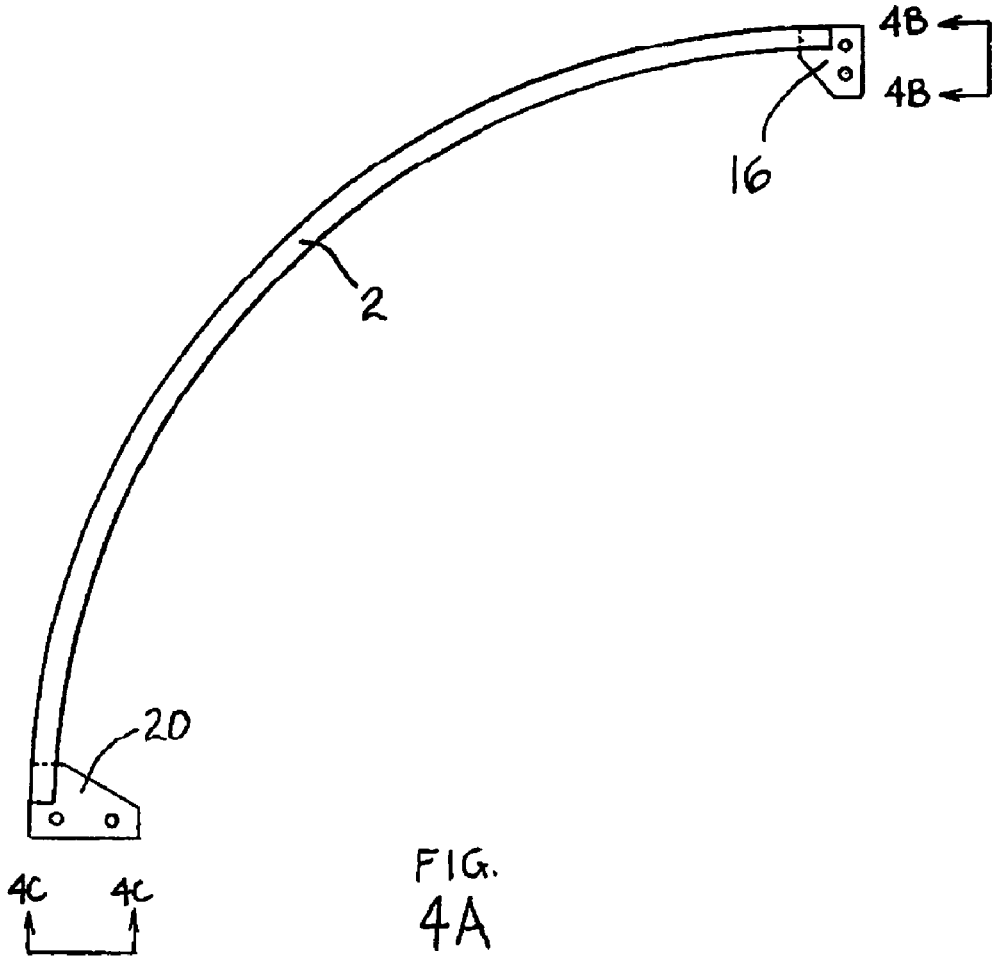
FIG. 4A is a side view of a steel rib for the dome structure.

As shown in FIG. 4A, which is a Rolled Tube detail of a steel rib 2, the rib is basically a rolled steel tube in elevation with a lower end and an upper end. The tube is factory rolled to the radii specific for the project being fabricated and is not limited to a single radius. For domes that require an elliptical form two or more different radii may apply from two or more different points of origin in order to achieve the rolled form.

Figure 4C:
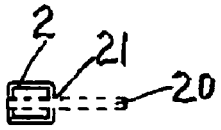
FIGS. 4B and 4C are end views of the steel rib of FIG. 4A, taken from the directions 4B-4B and 4C-4C, respectively.
Figure 4B:
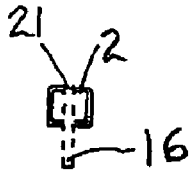

FIGS. 4B and 4C show the Cross Section detail of the rolled steel tube shaped rib 2 (with the tongues 16, 20 at the upper and lower ends of the rib shown schematically in dashed lines). FIG. 4B shows the cross section associated with the upper end of the steel rib 2 in preparation for placing and welding of a steel plate (tongue) 16 at the factory. Both sides of the steel plate 16 are welded when inserting the plate into the slot in the rolled steel tube. FIG. 4C shows a Cross Section detail of the rolled steel tube associated with the lower end of the rolled steel rib 2 in preparation for placing and welding a steel plate 20 at the factory. The rolled steel tube preferably has the substantially square shaped cross section, as shown in FIGS. 2C, 4B and 4C.

Figure 5A:
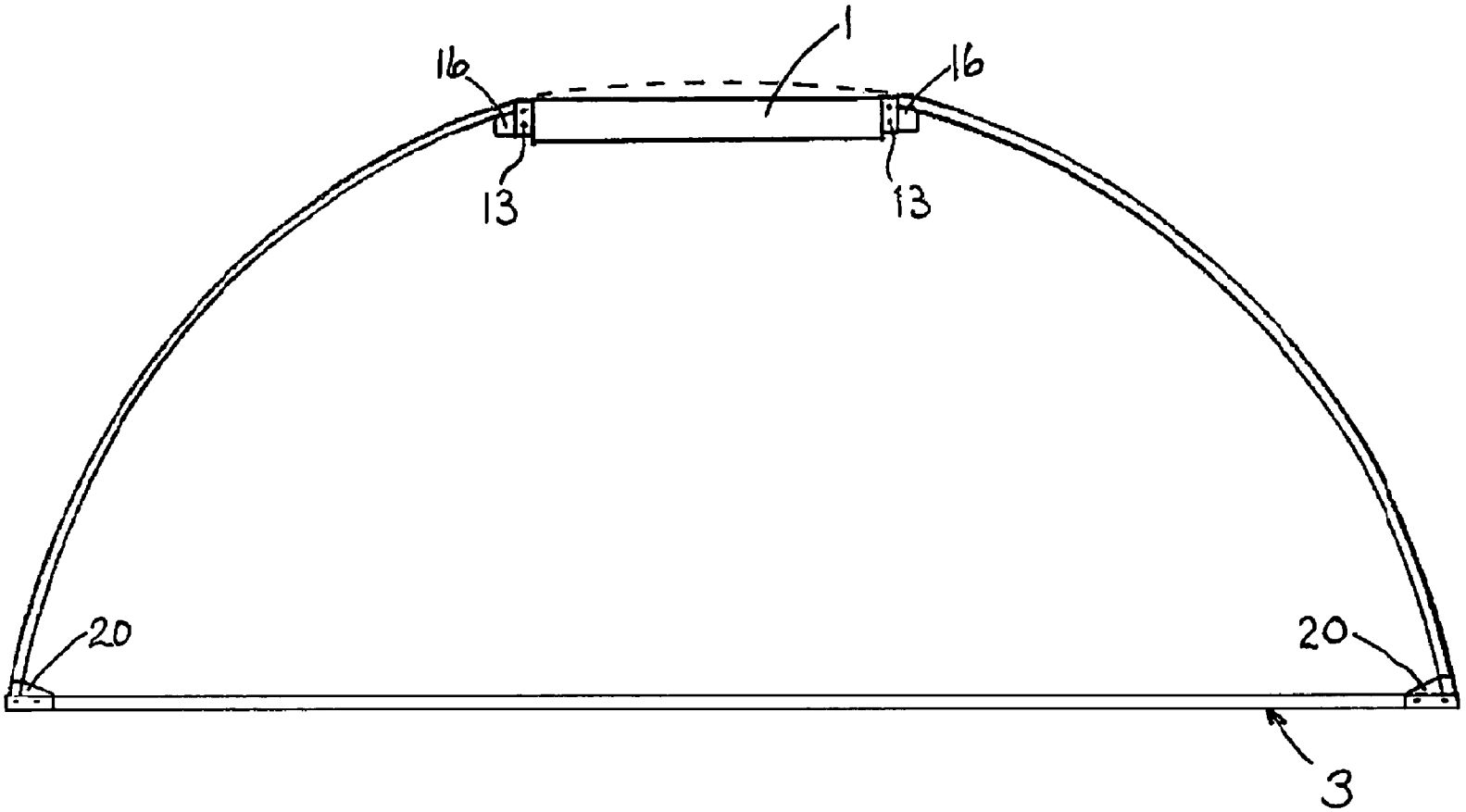
FIG. 5A is a partial, schematic illustration of a pair of steel ribs connected to and extending between the compression ring and the lower ring.

FIG. 5A provides a Cross Section of the dome, and shows the three main elements being the compression ring (1) that sits at a higher elevation than the steel inner and outer rings that form the lower tension ring (3) and the steel ribs (2) that connect the compression ring 1 and the lower tension ring 3. The compression ring and tension ring are concentric to each other. This section shows a scaled relationship between the diameter and the rise of dome as well as the intended form as further expressed by the radii of the rolled rib. Further, this section shows the connections that join the steel rib 2 to the upper compression ring 1 and to the lower tension ring 3 (further details of the connection between the upper end of a rib and the compression ring being shown in FIGS. 2B and 5B, and further details of the connection between the lower end of a steel rib and the lower tension ring 3 being shown in FIGS. 2B, 2C and 5C).

Figure 5C:
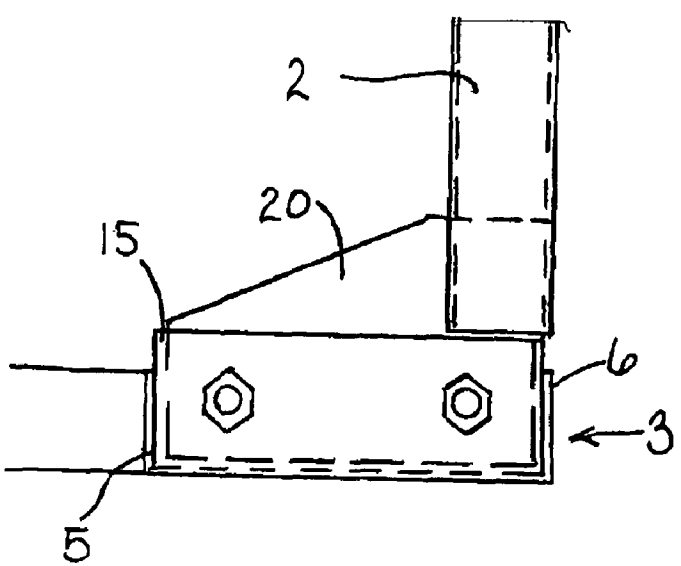
Figure 5B:
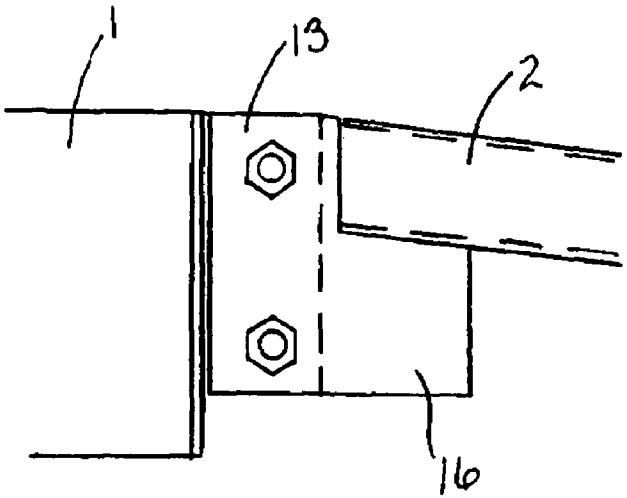
Figure 6A:
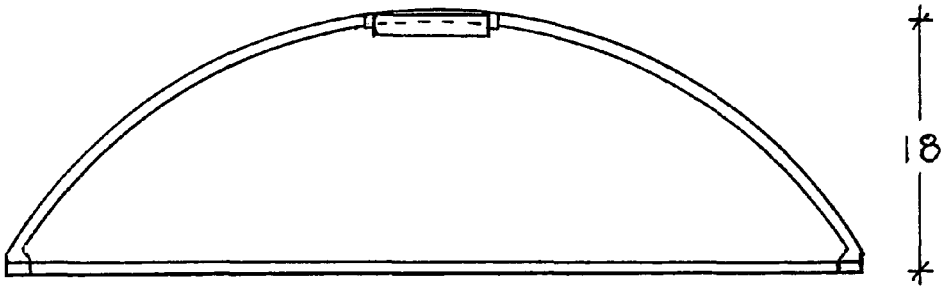
FIGS. 6A-6E are schematic illustrations of portions sections of dome shaped structural systems, to illustrate different dome shaped structural systems with different heights and diameters that can be produced according to the principles of the present invention.
Figure 6B:
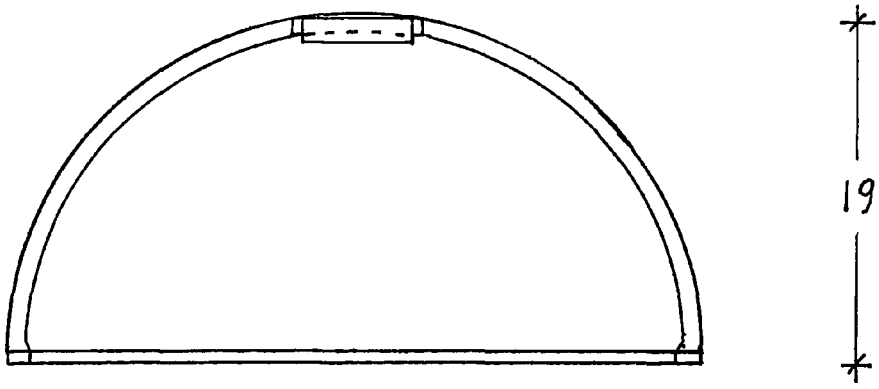
Figure 6C:
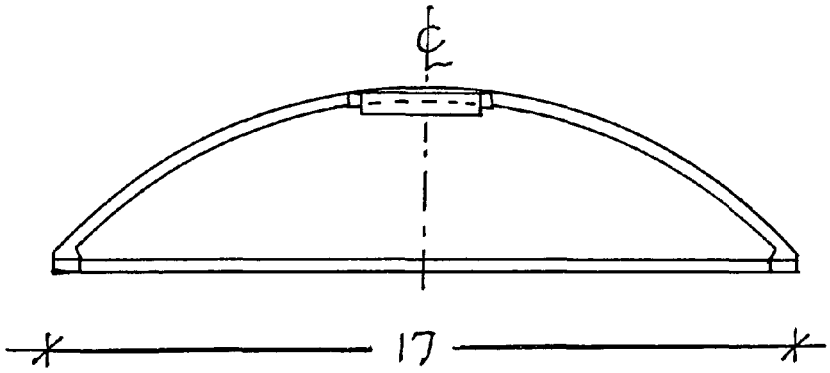
Figure 6D:
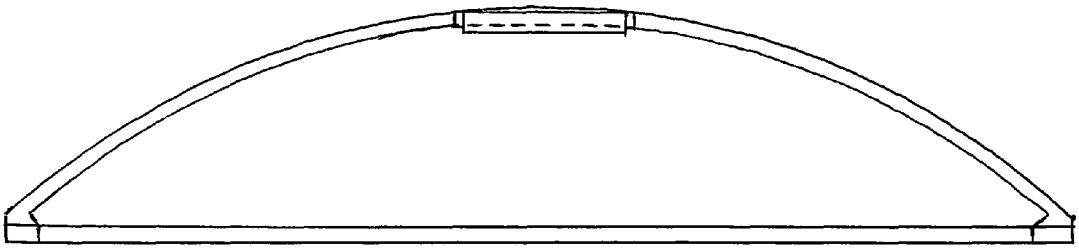
Figure 6E:
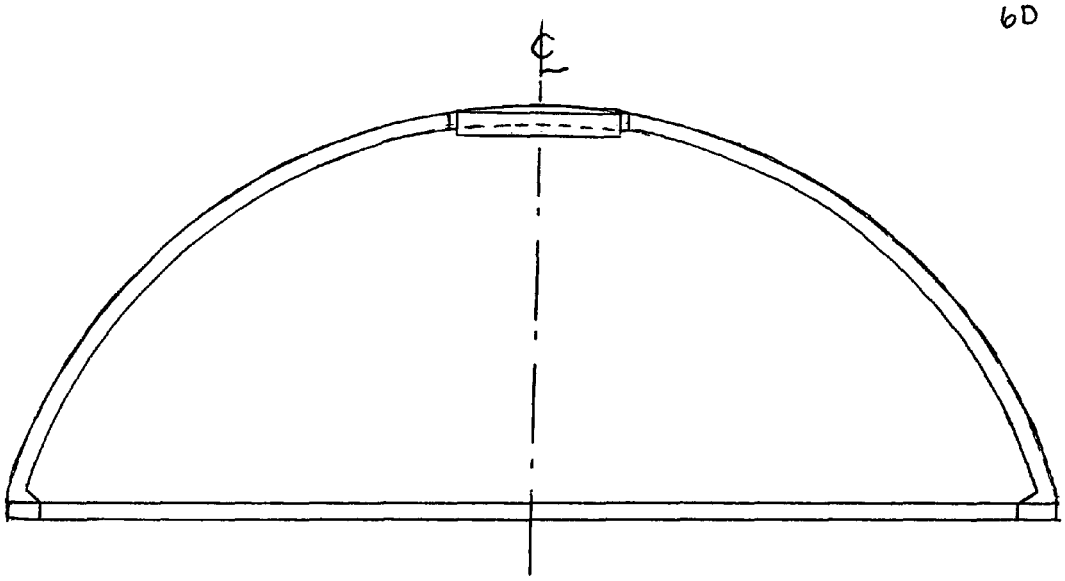

FIG. 5B details the Side View of the connection between the upper end of the tubular rib 2 and the compression ring 1. The steel plate (tongue) 16 from the tubular rib 2 and the steel rib mounting flange 13 from the compression ring 1 are lapped and mated to each other and secured with 2 each, ⅝" bolts and nuts 12. FIG. 5C details the Side View of the connection between the lower end of the tubular rib and the lower tension ring 3. The plate (or tongue) 20 that is coupled to the lower end of the steel rib 2 is positioned into the lower tension ring 3 at a location where a 4"×4"×¼" angle 15 is located. The flange or tongue 20 and 4" angle 15 are lapped and mated to each other and secured with 2 each, ⅝" bolts and nuts 12.

FIGS. 6A-6E shows an array of dome cross sections, as examples of the relationship between diameters and elevations that are used to fabricate a varied group of dome shapes (some example dimensions are shown at 17, 18, and 19, as noted on the parts list below) and FIGS. 6A-6E. The dome kit is not dependant on a one size compression ring or one size diameter of lower tension ring for all dome kits. The third variable is the height. Domes vary from one project to the next. This dome kit offers these variable dimensions with the maintenance of standardized elements, connectors, and fasteners.

As should be clear from the foregoing description, assembly of the dome structure begins with assembly of the lower steel ring 3. The lower steel ring 3 comprises the inner and outer steel rings 5, 6 that are concentric to each other and the lower ring 3 is formed from two or more lower ring sections, each of which comprises an inner ring part and an outer ring part. The inner and outer ring parts are joined together by the steel angles 15 and by the steel bars 7 located between the ends of the ring sections and which form gussets. The steel bars 7 and steel angles 15 are welded on both sides to the inner and outer ring parts and all the welding is done at the factory. There is no on site welding required as the kit parts are being assembled to form the dome shaped structural system.

Preferably, the lower steel ring 3 is constructed from four (can be two or more) smaller ring sections, using the splice assemblies 4. The lower ring sections are placed flat on the ground or a concrete slab. The lower steel ring sections will have a factory mark at each end that will match the adjoining end of the next lower steel ring section in sequence. Correctly move the sections into a circle by matching the ends so that the adjoining gussets 7 at the ends of the adjacent ring sections. Join the sections by using the splice assembly 4 comprised of two splice plates 11 and nuts, bolts and washers 12. Adjoining gussets 7 at the ends of the adjacent ring sections are fastened directly to each other, using a ¾" nut and bolt 14, and are connected with each other via the splice assemblies 14.

Initially, all bolting at the splice assemblies 4 should be loose fitting to ensure alignment at all splice plates 11 prior to final tightening. Using the splice plate 11 insert the ⅝" bolts 12 so that the threaded portion of the bolt goes to the inside of the lower steel rings.

The Dome Kit is supplied with the same quantity of steel ribs 2 as there are 4" steel angles 15 at the lower steel ring 3 and the same quantity of rib mounting flanges 13 at the compression ring 1. All rib mounting flanges 13 are factory welded to the compression ring (see e.g. welds 9). The ribs 2 are preferably of a type having a structural strength that is suitable for the intended application.

The assembler will need to position the compression ring 1 at the appropriate height in the exact center of the lower steel ring 3. For example, it is contemplated that an assembler will use an apparatus such as a pair of saw horses or a mounting block. The mounting apparatus, blocking and shims are not included in the Dome Kit. They are placed on the ground, at the center of the lower steel ring 3. Adjust the components to configure the base of the compression ring at the desired height which will be the dome's elevation less 10 inches. The top of the compression ring 1 will be labeled. Then the compression ring 1 is placed on the mounting apparatus. Be accurate as possible when situating the compression ring 1. Use the center point of the dome diameter (FIG. 6E) to align with the center point of the compression ring diameter. Once achieving this, the next step is to visually or by a mechanical device, align the rib mounting flanges 13 in the same plane as the 4" steel angles 15 located in the lower steel rings 3. This will ease the placement of the ribs 2 in the next step.

To assemble the ribs 2 into the structure, begin by placing a first set of steel ribs 2 into the lower steel ring 3 (one set of ribs equals two ribs), and align and mate the tongues 20 with the gussets 7. With steel rib 2 in hand; place the tongue 20 of the steel rib 2 into the lower steel tension ring 3 at the location where you find a 4" steel angle 15. Be sure to place the tongue 20 or rib 2 along side of the vertical side of the steel angle 15 and loosely couple with the ⅝" bolts and nuts 12. Gently swing the rib 2 in a hinging motion toward the rib mounting flanges 13 at the compression ring 1. Have a second person on the opposite side of the ring to stabilize the compression ring 1 while this action is taking place. The tongue 16 at the upper end of the rib is mated against a rib-mounting flange 13, and is loosely bolted to the flange 13. When the steel ribs 2 are all properly positioned in this manner, the nuts and bolts assemblies are tightened, so securely fasten the ribs 2 to the compression ring 1 and the lower tension ring to form the dome structure.

One set of ribs equals two ribs. Three sets of ribs equals six total. Always position one rib across from the other when beginning the assembly. After positioning the first or the second set of ribs, depending on the accuracy first taken by the assemblers, it may be useful to adjust the support dimension below the compression ring 1 by adding or subtracting steel blocks or shims to obtain a reasonable height 18 for achieving the rib 2 placements.

The second set of steel ribs 2 should be at 90 degrees or a right angle to the first set. This will help level and secure the compression ring 1. Be sure of the alignment and the fitting on both axes at this time. Now the bolting should be made snug at the compression ring 1 and lower steel ring 3 connections. After placing three or four sets of steel ribs 2 the compression ring 1 becomes self-supporting. The sawhorses or mounting block can be removed to allow completion of the steel rib 2 installation. Using an adjustable or socket wrench the tightening of all connectors can be easily accomplished. The dome shaped structural system is now ready for the builders use.

If the dome shaped structural system being assembled is similar to FIG. 1, then a suggested mounting apparatus could be a metal scaffold with adjustable heights and the use of steel blocks and shims.

It is believed the following additional comments will be useful to those in the art.

1. In the 10 foot to 36 foot range of "dome kit" structures, the rib dimensions remain constant at 3 inches by 3 inches. They grow or shrink in curvature and length per each customer order.

2. The lower rings 3 remain the same. A ¼ inch by 3 inch flat stock steel is used for the inner and outer rings and the gussets. There is one ¼"×4"×4" angle 15 for every rib destination at the lower steel ring. Where a splice assembly 4 occurs, there will be two gussets 7.

3. The 4 inch steel angle 15 within the lower steel rings 3 does not change. One for each rib 2.

4. The compression ring 2 begins at a 36 inch outside diameter at the 10 foot dome kit and increases after the 16 foot diameter to a 5 foot or larger outside diameter at the 36 foot diameter dome kit.

5. All steel angles, gussets, rib mounting flanges and the compression ring are factory welded. Factory welds are performed by certified welders to meet or exceed the ASTM standards as required.

6. The ⅝" bolts, nuts and washers do not change except for the length of the ⅝" bolts.

7. As seen from FIG. 1, in an assembled dome structure, there are spaces between adjacent steel ribs 2. The spaces enable mechanical, electrical and/or natural light systems to be located in those spaces, and, if desired, conveniently connected to the ribs.

8. While a preferred Dome Kit includes all hardware components required to assemble a dome shaped structural system, it is believed possible to practice the assembly process and produce a dome shaped structural system from a Dome Kit that includes some hardware components, and has specifications for the other hardware components that can be acquired separately by (or for) the assembler. Additionally, because of the nature of the components that make up a Dome Kit, the components forming part of the Dome Kit may be included in a single package or container (or provided on a pallet with a shrink wrap cover), or may be packaged separately (or not packaged at all), but will be bundled or otherwise provided in a way that makes them all available to an assembler.

Accordingly, as seen from the foregoing description, applicant has provided a new and useful dome kit that can be used to conveniently assemble a new and useful dome structure, by a new and useful method. With the foregoing description in mind, various ways to configure a dome kit, and its components, and to assemble a new and useful dome structure will become apparent to those in the art.

PARTS LIST

1. compression ring ¼ inch plate steel×10 inch height, factory rolled and welded
2. steel rib
3. lower steel inner and outer rings, ¼ inch wide×3 inches height, standard steel, tension ring
4. splice assembly

5. inner lower ring
6. outer lower ring
7. steel bar, ¼ inch×3 inch height×11½ inch length, factory welded to lower ring to form a gusset
10. factory ready bolt holes
11. splice plate, ¼ inch×3 inches×14 inches, standard steel with factory ready bolt holes
12. ⅝ inch standard steel bolt, nut and washers
13. ¼ inch×4 inch depth×8 inch length standard steel rib mounting flange
14. factory ready bolt holes for ¾ inch standard steel bolt
15. ¼ inch×4×4 inch×11½ inch length standard steel angle, see FIGS. 2A, 2C
16. rib upper tongue
17. dome shaped structural system diameter, with measurements taken from outside to outside of lower steel ring with center line
18. dome shaped structural system elevation, with measurements taken from bottom of lower rings to continued arc at top center of compression ring
19. image of dome shaped structural system with elevation being one half the diameter
20. rib lower tongue
21. slot in rib

The invention claimed is:

1. A method of forming a dome shaped structural system, comprising the steps of a) providing a compression ring, having a plurality of rib mounting flanges, each having one or more openings configured to receive a fastener;

b) providing a lower ring with a larger but similar shape to the compression ring, the lower ring having connecting portions having openings, each of which is configured to receive a fastener;

c) providing a plurality of metal ribs configured to extend between the lower ring and the compression ring, each metal rib comprising a rolled steel tubular member having an upper end, a lower end, a predetermined curvature between the upper and lower ends, and metal plates extending partially out of the upper and lower ends, respectively, each of the metal plates one or more openings, each configured to receive a fastener;

d) positioning the compression ring in relation to the lower ring such that the compression ring is above the lower ring and in centered relation to the lower ring, and e) connecting the lower ends of the metal ribs with the lower ring and the upper ends of the metal ribs with the compression ring, by aligning openings in the steel plates with openings in the flanges of the compression ring and with the connecting portions of the lower ring, and inserting fasteners through the aligned openings, to form a dome shaped structural system;

wherein the compression ring includes the rib mounting flanges at predetermined locations on the compression ring, and the metal plate at the upper end of each rib extends into and is fixed to a slot in the rib and wherein the lower ring has angle members that form the connecting portions of the lower ring, and the step of connecting the rolled steel tubular ribs with the lower ring comprises aligning and coupling the plates at the lower ends of the rolled steel tubular ribs with respective connecting portions of the angle members of the lower ring.

2. A method as defined in claim 1, wherein the dome structure is assembled as a complete unit for attachment as a complete unit to a building structure.

* * * * *